US007967347B1

(12) United States Patent
Johnson

(10) Patent No.: US 7,967,347 B1
(45) Date of Patent: Jun. 28, 2011

(54) DELIVERY VEHICLE WITH AUTOMATIC DOOR UNLOCKING SYSTEM

(76) Inventor: Lott Johnson, Grifton, NC (US)

( * ) Notice: Subject to any disclaimer, the term of this patent is extended or adjusted under 35 U.S.C. 154(b) by 925 days.

(21) Appl. No.: 10/820,578

(22) Filed: Apr. 8, 2004

(51) Int. Cl.
*E05C 3/16* (2006.01)

(52) U.S. Cl. ..... 292/201; 292/DIG. 61

(58) Field of Classification Search ..... 292/201, 292/DIG. 25, 210, 216, 1, DIG. 61; 49/279, 49/280; 16/66, 84
See application file for complete search history.

(56) References Cited

U.S. PATENT DOCUMENTS 1,555,174 A * 9/1925 Williams ..... 292/DIG. 25
2,801,309 A * 7/1957 Higbie et al. ..... 200/61.82
3,016,968 A * 1/1962 Lenz et al. ..... 292/201
3,113,447 A * 12/1963 Oishei ..... 292/201
3,580,623 A * 5/1971 Peters ..... 292/201
4,170,374 A * 10/1979 Garcia ..... 292/201
4,815,773 A * 3/1989 Merrell ..... 292/DIG. 32
4,866,963 A * 9/1989 Leininger et al. ..... 292/144
5,357,143 A 10/1994 Lehr et al.
5,532,521 A 7/1996 Leininger
6,050,116 A * 4/2000 Cole ..... 292/144
6,793,260 B2 * 9/2004 Crean ..... 296/37.1

* cited by examiner

*Primary Examiner* — Peter M Cuomo
*Assistant Examiner* — Christopher Boswell
(74) *Attorney, Agent, or Firm* — Coats & Bennett, P.L.L.C.

(57) ABSTRACT

A vacuum actuated door latching assembly for use in combination with a door of a delivery vehicle. The latch assembly moves between locked and unlocked positions and includes a pneumatic actuator that drives the latch assembly between the locked and unlocked positions. Extending from the pneumatic actuator is a vacuum line that is adapted to be connected to a vacuum source such as the engine of the delivery vehicle. A control valve is disposed between the vacuum source and the pneumatic actuator for controlling the activation of the pneumatic actuator. A biasing device engages the door and biases the door towards and open position. Thus, when the latching assembly is actuated the door of the delivery vehicle is unlatched and the biasing device causes the door to assume the open position.

3 Claims, 4 Drawing Sheets

DELIVERY VEHICLE WITH AUTOMATIC DOOR UNLOCKING SYSTEM

FIELD OF THE INVENTION

The present invention relates to delivery vehicles, and more particularly to an automatic door unlocking system for the vehicle.

BACKGROUND OF THE INVENTION

Delivery vehicles are widely used throughout the United States and the world. Typically these delivery vehicles have a small cab area and behind the cab area there is a load or cargo area. A bulkhead ordinarily separates the load or cargo area from the cab and typically a sliding door is placed in the bulkhead. When a driver of a delivery vehicle reaches a location where packages are to be delivered, the driver will bring the vehicle to a stop, open the sliding door with a key, retrieve the package, and upon leaving the vehicle, lock the door. This is a time consuming endeavor and it is repeated hundreds of times by the same driver over a relatively short period of time.

Therefore, there is and continues to be a need for an automatic door locking and unlocking system for a delivery vehicle that will enable the driver to quickly and easily retrieve and deliver packages without having to spend a great deal of time unlocking and locking the access door and which provides ample security for protecting the cargo within the vehicle.

SUMMARY OF THE INVENTION

The present invention entails a vacuum actuated automatic door latching assembly for use in a delivery vehicle. The latching assembly comprises a latch that is adapted to be associated with the access door of the delivery vehicle. The latch is movable between a locked position and an unlocked position. The system further comprises a pneumatic actuator operatively associated with the latch for causing the latch to move between the locked an unlocked position. A vacuum line is connected to the pneumatic actuator and extends therefrom and is adapted to connect to a vacuum source. A control valve is disposed between the vacuum source and the pneumatic actuator for controlling the actuation of the pneumatic actuator. Once actuated, the pneumatic actuator will operatively engage the latch and cause the latch to move from the locked position to the unlocked position.

In one embodiment, the latch assembly described above is provided with a biasing device for engaging the door and biasing the door towards an open position. Thus the biasing device will automatically push or urge the access door open.

The present invention also entails a method of unlocking an access door to a load or cargo department of a delivery vehicle. This method entails directing a vacuum from an engine of the delivery vehicle through a line to a pneumatic actuator that is operatively associated with a latch assembly that operates to lock and unlock the access door. The latch assembly includes a latch or locking lever that is movable between a locked position and an unlocked position. This method entails utilizing the vacuum to actuate the pneumatic actuator and when the pneumatic actuator is so actuated, the actuator engages the latch and moves the latch from the locked position to the unlocked position. This permits the access door to open.

In one particular embodiment, the method described above utilizes the vacuum of an engine that forms a part of the delivery vehicle. Here a vacuum line extends from the engine to the pneumatic actuator. A control valve is interposed in the vacuum line and simply by actuating the control valve, vacuum is directed through the line to the pneumatic actuator causing the same to be actuated. In the process the pneumatic actuator engages the latch and moves the latch to an unlocked position.

Other objects and advantages of the present invention will become apparent and obvious from a study of the following description and the accompanying drawings, which are merely illustrative of such invention.

DESCRIPTION OF THE INVENTION

Figure 1:
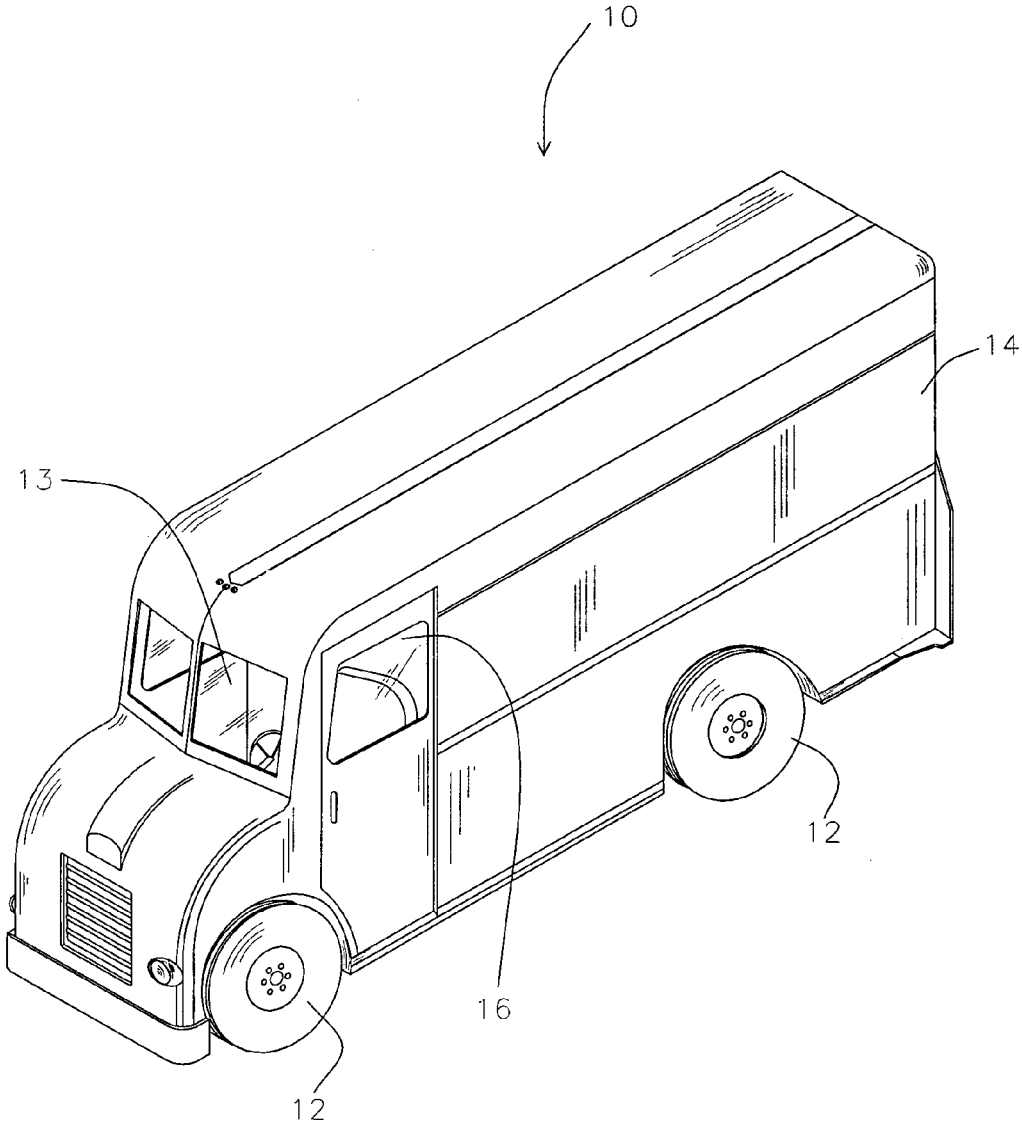
FIG. 1 is a perspective view of a delivery vehicle.

With further reference to the drawings, a conventional delivery vehicle is shown therein and indicated generally by the numeral 10. Vehicle 10 includes front and rear wheels 12, a cab area 13, and a load or cargo compartment 14. The load or cargo compartment 14 is separated from the cab 13 by a transverse bulkhead 16. As is appreciated, the area of the vehicle rearwardly of the bulkhead 16 comprises an area for receiving cargo such as packages, etc. A door 18 is formed in the bulkhead 16. In this case, and in many typical cases, the door comprises a sliding door 18.

Figure 2:
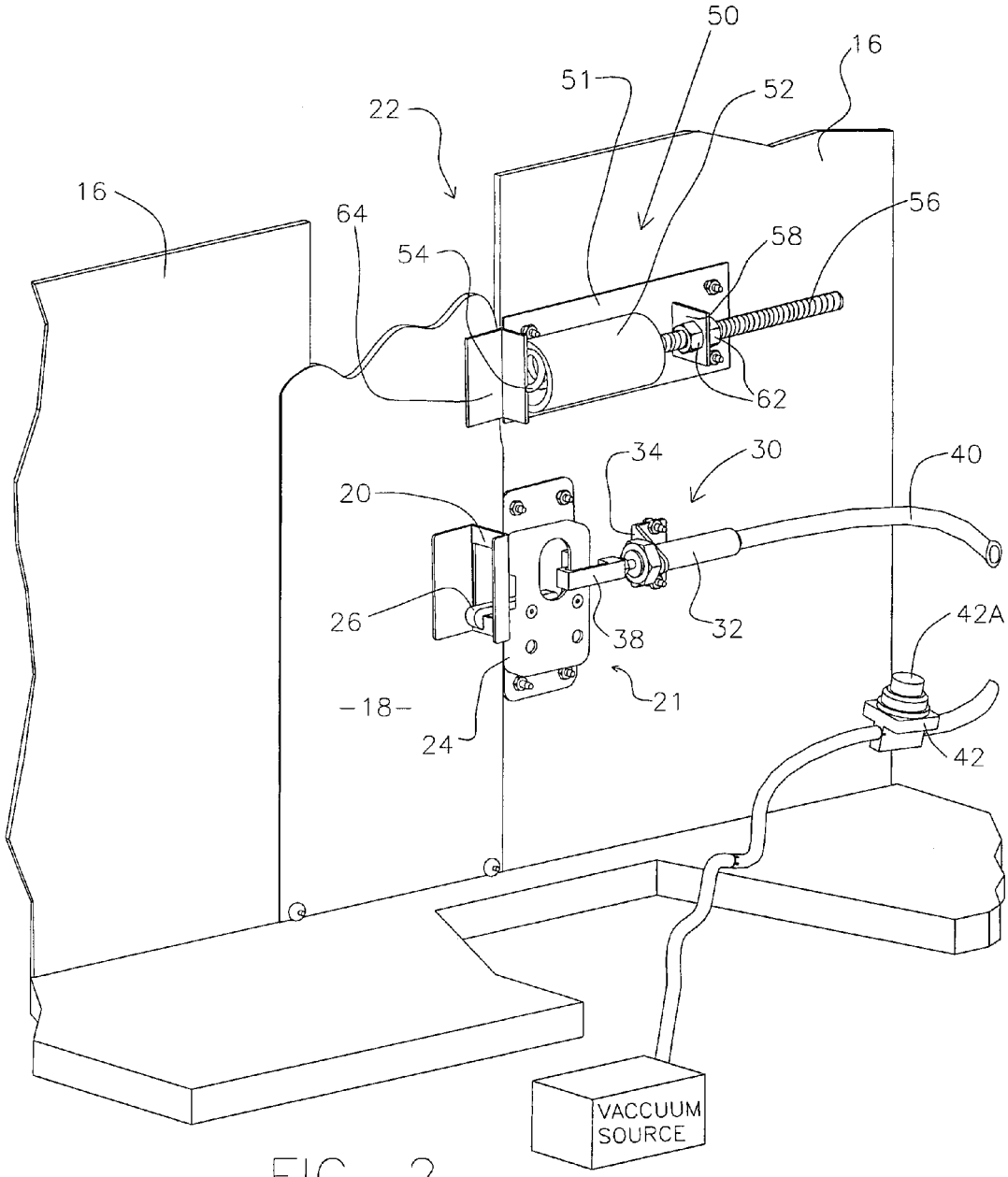
FIG. 2 is a fragmentary perspective view of a bulkhead and access door of a delivery vehicle shown with a door in a locked position.
Figure 3:
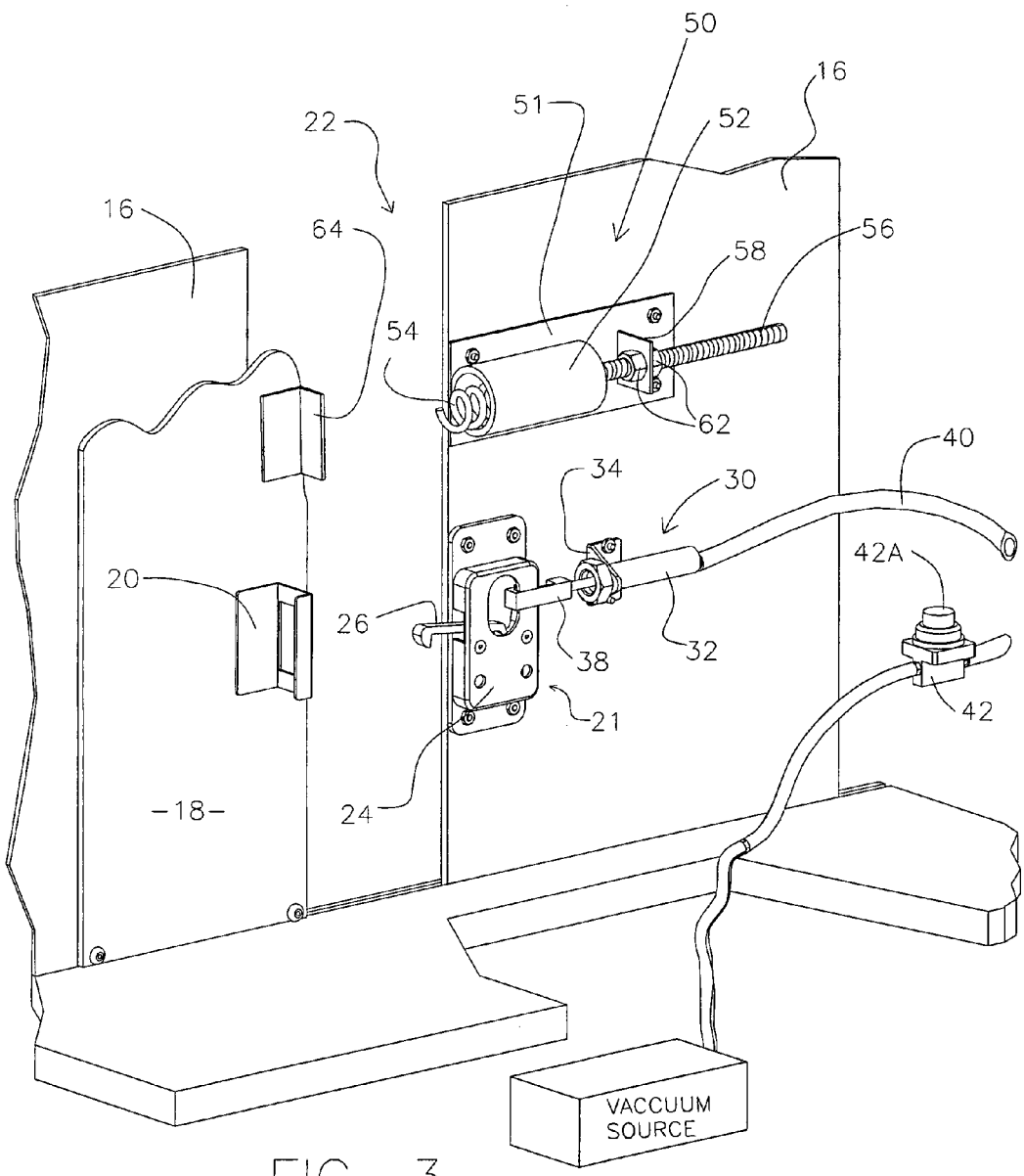
FIG. 3 is a view similar to FIG. 2, but with the door being shown in an unlocked position.
Figure 4:
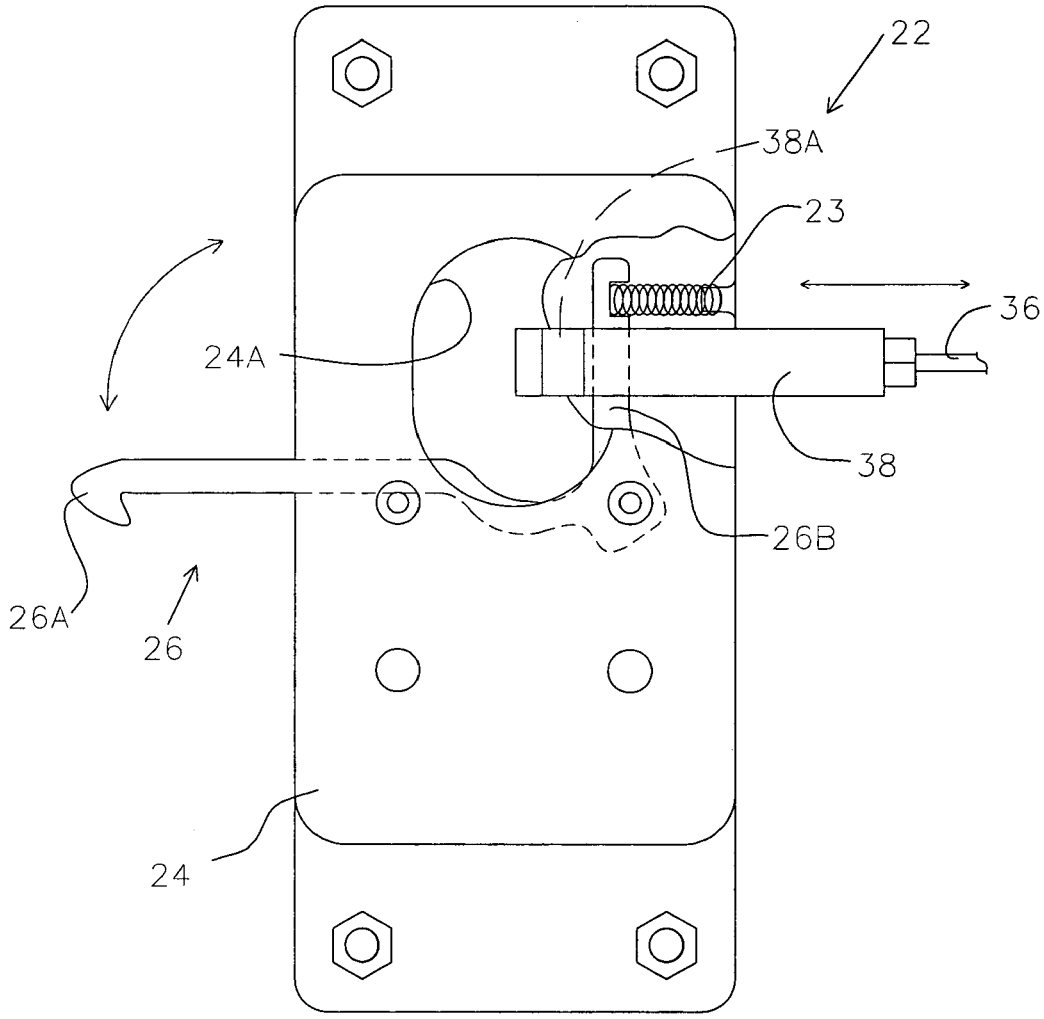
FIG. 4 is an enlarged view of a latch assembly of the type shown in FIGS. 2 and 3.

Turning to FIGS. 2-4, there is provided a latch assembly indicated generally by the numeral 22. Latch assembly 22 is mounted to the bulkhead 16 adjacent the sliding door 18. As will be appreciated from subsequent portions of the disclosure, the latch assembly 22 is movable between locked and unlocked positions. In the locked position, the latch assembly 22 is operative to engage a receiver 20 mounted on the sliding door 18 so as to lock the sliding door and to close the access opening that is created when the sliding door 18 is open. Further, as will be appreciated, the latch assembly 22 may assume an unlocked position and in the unlocked position, the access door 18 can be opened in order to provide convenient access to the cargo compartment 14.

The views illustrated in FIGS. 2 and 3 show portions of the back of the bulkhead 16 and sliding door 18. The opposite side of the bulkhead 16 and sliding door 18 faces the cab area of the vehicle. The latch assembly includes a lock 21 that is of a conventional design. Lock 21 includes a housing 24 having a back plate with an access opening 24A formed therein. In FIG. 2, it is seen where the lock 21 and housing 24 are secured to the backside of the bulkhead 16. On the front of the bulkhead, opposite the housing 24, there is provided a key receiver for receiving a key that will lock and unlock the lock 21.

Continuing to refer to the lock 21, the same includes a pivotally mounted locking lever 26. Locking lever 26 is pivotally mounted within the housing 24 and assumes a generally L-shape. Locking lever 26 includes a hook end portion 26A and an actuating end portion 26B. Locking lever 26, as noted above, is pivotally mounted between these opposite end portions.

In FIG. 4, the locking lever 26 is shown in the locked position. Lock 21 is provided with a spring 23 that biases the locking lever to the locked position shown in FIG. 4. That is, the spring biases the locking lever counterclockwise to the position shown in FIG. 4. A stop is provided within the lock 21 to prevent the locking lever 26 from rotating further clockwise from the position that is shown in FIG. 4. As will be appreciated from subsequent portions of the disclosure, when the locking lever 26 assumes a position shown in FIG. 4, the hook end 26A will extend into a receiver 20 that is fixed to the door 18 and projects therefrom. This will effectively lock door 18 to the bulkhead 16.

Locking assembly 22 includes a pneumatic actuator indicated generally by the numeral 30. Pneumatic actuator 30 is mounted adjacent the lock 21 and locking lever 26 thereof, as illustrated in FIGS. 2 and 3. The pneumatic actuator 30 includes a pneumatic cylinder 32 that is mounted on a bracket 34 that is in turn secured to the backside of bulkhead 16. Pneumatic cylinder 32 is of a conventional design and includes a piston that reciprocates back and forth therein. Extending from the piston is a rod 36. It is noted that the pneumatic actuator is mounted adjacent the lock 21 such that the rod 36 of the piston projects towards the housing 24 of the lock. Secured to the rod 36 of the piston projecting from the cylinder 32 is an arm 38. Arm 38 is spaced such that it projects past the backside of the housing 26 and across a portion of the access opening 24A formed in the housing 24. Formed on the end portion of arm 38 is a projection or end portion 38A that projects inwardly through the access opening 24A. The projection 38A extends into the plane of the actuating end portion 26B of the locking lever 26. This will enable the projection 38A to engage the actuating end 26B of the locking lever 26 during an unlocking operation. As will be appreciated from subsequent portions of this disclosure and as viewed in FIG. 4, when the latching assembly is actuated so as to unlock the door 18, the arm 38 will move left to right and in the process the projection 38A will engage the actuating end 26B of the locking lever 26 and cause the locking lever to rotate clockwise as viewed in FIG. 4. This will cause the hook end 26A of the locking lever 26 to disengage the receiver 20 secured to the door 18, permitting the door 18 to open.

A vacuum line 40 extends from the pneumatic cylinder 32. In the case of the present invention, the vacuum line 40 would extend to or be operatively connected to the engine of the vehicle 10. Interconnected in the vacuum line 40 between the pneumatic cylinder 32 and the source of the vacuum is a control valve 42. Control valve 42 is a conventional valve that in the case of the embodiment illustrated herein is normally closed. Valve 42 can be opened by simply pushing downwardly on the actuating button 42A that forms a part of the valve. Once actuating button 42A has been pushed down, the vacuum line 40 is open to the source of the vacuum and accordingly the vacuum can reach the pneumatic cylinder where it will effectively cause the piston to move from left to right within the cylinder 32 as viewed in FIGS. 2 and 3, thereby moving the locking lever 26 to the unlocked position.

The latching assembly 22 of the present invention further comprises a biasing member or assembly, indicated generally by the numeral 50. Biasing member 50 is operative to bias the door 18 towards an open position while the door 18 is locked. Thus, as will be appreciated from the drawings and the disclosure to follow, once the latching assembly 22 assumes an unlocked position or mode, the biasing member 50 will cause the door 18 to be at least slightly opened. Viewing biasing member or assembly 50 in more detail, it is seen that the same comprises a mounting bracket 51 for mounting the biasing member 50 to the bulkhead 16 adjacent the door 18. A sleeve 52 is mounted on the bracket 51. A spring 54 is secured to a threaded bolt 56 that extends through the sleeve 52. Threaded bolt 56 extends through a stop 58 mounted on the mounted bracket 51. A pair of opposed threaded nuts 62 are secured on the threaded bolt 56 and can be tightened from each side against the stop 58 so as to retain the spring 54 in an appropriate position.

A stop 64 is secured to the door 18 and is generally aligned for engagement by the biasing assembly 50. More particularly, by adjusting the nuts 62 the spring 54 can be appropriately adjusted such that when the door assumes a closed position, that the stop 64 is spaced with respect to the spring 54 such that the spring exerts a certain amount of opening force against the stop. As noted above, the degree of force exerted can be adjusted by selectively selecting the spring 54 and/or adjusting the position of the threaded bolt 56 with respect to the stop 58.

In operation, the door 18 is normally locked. When locked, the locking lever 26 extends as shown in FIG. 4 into engagement with the receiver 20. It should be pointed out that at this time, the lock as viewed in FIG. 4 can be unlocked through a conventional key that would be inserted into the lock 21 from the side of the bulkhead opposite of that shown in FIGS. 2 and 3.

In any event, once the driver of the vehicle 10 arrives at a stop where a package or other cargo is to be delivered, before the engine is shut down, the driver will actuate the control valve 42. This will permit vacuum from the engine to be directed through the vacuum line 40 to the pneumatic cylinder 32. This will cause the piston rod 36 to move left to right as viewed in FIG. 4. As the piston rod 36 moves left to right, the projection 38A will engage the actuating end 26B of the locking lever 26. This will cause the locking lever 26 to rotate clockwise as viewed in FIG. 4 to where the end 26A of the locking lever will disengage the receiver 20. Once locking lever 26 disengages the receiver 20, then the biasing assembly 50 will push or urge the door 18 to at least a slightly open position. The driver will then shut the engine down. Because the locking lever 26 is biased to rotate downwardly to the locked position shown in FIG. 4, the actuating end 26B will engage the projection 38A of the arm 38 and cause the arm 38 and rod 36 to move right to left as viewed in FIG. 4 until the locking lever is stopped at its normal locking position shown in FIG. 4.

Once the driver has removed the package from the cargo department 14, the sliding door 18 can be moved towards the closed position. In this process, the receiver 20 will engage the locking end 26A of the locking lever 26 and because of the angled shape of the hook end 26A, the locking lever 26 will ride over the receiver 20 until the receiver has reached a certain point at which time the biasing action of the locking lever 26 will cause the same to rotate slightly counterclockwise into the locked position shown in FIGS. 2 and 4.

It is appreciated that the latch assembly 22 when locked, cannot be made to assume the unlocked position when the vehicle engine is shut down. This is because there is no source for the vacuum that is used to actuate the pneumatic actuator 30.

From the foregoing discussion, it is appreciated that the present invention presents an efficient and cost effective way of automatically unlocking the access door for a deliver vehicle. By utilizing the system and method of the present invention, a great deal of time is saved at each delivery stop and security is maintained.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A vacuum actuated automatic door latching assembly for unlocking a door of a delivery vehicle, comprising:

a. a latch operatively associated with the door for latching the door, the latch movable between the lock and unlocked positions;

b. a pneumatic actuator operatively associated with the latch for causing the latch to move between the locked and unlocked positions;

c. a vacuum line connected to the pneumatic actuator and adapted to connect to a vacuum source associated with the vehicle;

d. a control valve disposed between the vacuum source and the pneumatic actuator for controlling the activation of the pneumatic actuator; and e. a biasing device engaging the door and biasing the door towards an open position;

f. wherein the device includes a spring; and g. wherein the spring is adapted to extend between a stop disposed on the door and an area adjacent the door, and wherein the position of the spring is adjustable with respect to the door.

2. A vacuum actuated automatic door latching assembly for unlocking a door of a delivery vehicle, comprising:

a. a latch operatively associated with the door for latching the door, the latch movable between the lock and unlocked positions;

b. a pneumatic actuator operatively associated with the latch for causing the latch to move between the locked and unlocked positions;

c. a vacuum line connected to the pneumatic actuator and adapted to connect to a vacuum source associated with the vehicle;

d. a control valve disposed between the vacuum source and the pneumatic actuator for controlling the activation of the pneumatic actuator; and e. a biasing device engaging the door and biasing the door towards an open position;

f. wherein the device includes a spring;

g. wherein the spring is adapted to extend between a stop disposed on the door and an area adjacent the door, and wherein the position of the spring is adjustable with respect to the door; and h. wherein the spring is at least partially contained within a sleeve.

3. A delivery vehicle having a vacuum actuated latch assembly for latching an access door to a load compartment, comprising:

a. an engine for powering the vehicle;

b. a compartment for receiving and holding a load;

c. a sliding door for permitting access to the compartment of the vehicle;

d. a vacuum actuated latch assembly for automatically unlocking the door, the vacuum actuated latch assembly comprising:

i. a latch operatively associated with a door for locking the door;

ii. the latch being movable between a locked and an unlocked position;

iii. a pneumatic actuator operatively associated with said latch for causing the same to move between the locked and unlocked position;

iv. a vacuum line connected to the pneumatic actuator and extending to the engine of the vehicle such that the engine of the vehicle serves as a vacuum source for the pneumatic actuator, v. a control valve disposed between the engine and the pneumatic actuator for controlling the actuation of the pneumatic actuator;

vi. a biasing device for engaging the sliding door and biasing the sliding door towards an open position, the biasing device being spaced from the latch assembly and operable independently of the latch assembly, and wherein the biasing device includes a spring disposed adjacent the sliding door and positioned with respect to the sliding door such that when the sliding door assumes a closed position the spring engages the sliding door and is compressed by the sliding door, and wherein when the latch is moved from the locked position to the unlocked position the spring forces the sliding door to open; and e. wherein the spring is at least partially housed within an elongated sleeve that is fixed adjacent the sliding door; and wherein the spring is secured to a threaded bolt that is held with a threaded support such that the threaded bolt can move back and forth axially within the threaded support so as to adjust the position of the spring with respect to the sliding door.

* * * * *